US005424719A

United States Patent [19]

Ravid

[11] Patent Number: 5,424,719

[45] Date of Patent: Jun. 13, 1995

[54] CONSUMPTION CONTROL

[76] Inventor: Tomer Ravid, Moshav Beit Oved 76 800, Israel

[21] Appl. No.: 132,591

[22] Filed: Oct. 6, 1993

[51] Int. Cl.[6] ..... G08B 21/00

[52] U.S. Cl. ..... 340/573; 340/540

[58] Field of Search ..... 340/573, 540, 529, 527

[56] References Cited

U.S. PATENT DOCUMENTS

| | | | |
|---|---|---|---|
| 3,885,576 | 5/1975 | Symmes | 340/573 |
| 4,557,275 | 12/1985 | Dempsey, Jr. | 340/573 |
| 4,975,682 | 12/1990 | Kerr et al. | 340/573 |
| 5,128,655 | 7/1992 | Shore | 340/573 |
| 5,258,745 | 11/1993 | Colling | 340/573 |

*Primary Examiner*—Glen Swann
*Attorney, Agent, or Firm*—Seidel Gonda Lavorgna & Monaco

[57] ABSTRACT

Consumption control apparatus has a rate meter operative for determining an actual rate at which an arm of a user is brought into an eating position during a consumption session, and an indicator operative for providing a sensible indication whenever the actual rate deviates unacceptably from a preselected, standard, eating rate. The apparatus preferably provides the user, during preselected learn/practice time intervals, with a sensible indication corresponding to the preselected standard rate. Preferably, a learn/practice time interval is automatically initiated at the beginning of each consumption session and/or following each unacceptable deviation from the preselected eating rate. The apparatus preferably further includes a memory for recording the number of unacceptable deviations from the preselected eating rate and a visual display for displaying the recorded number of unacceptable deviations. The rate meter preferably includes a position switch, associated with the arm of the user, which is activated each time the arm of the user is brought into the eating position.

47 Claims, 3 Drawing Sheets

FIG.1A
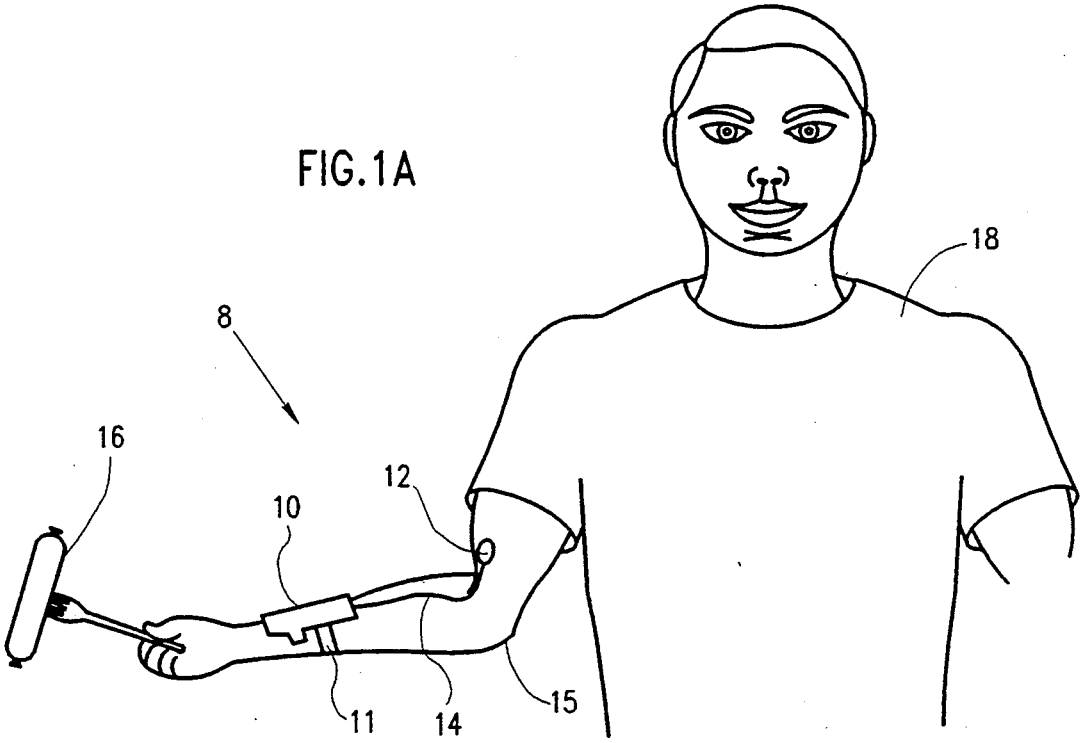
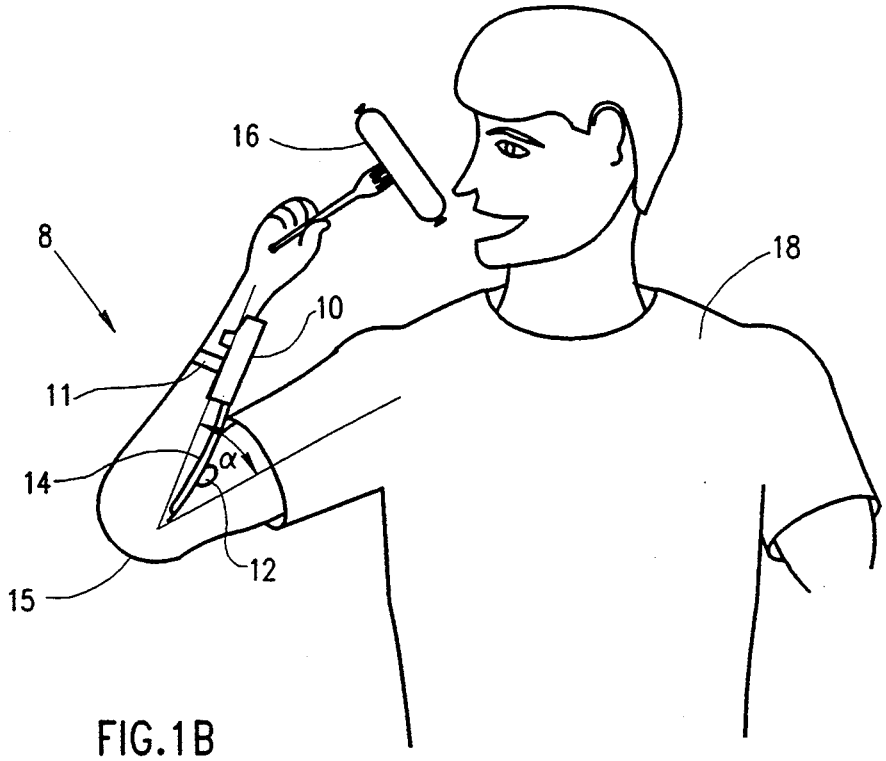
FIG.1B

FIG.2
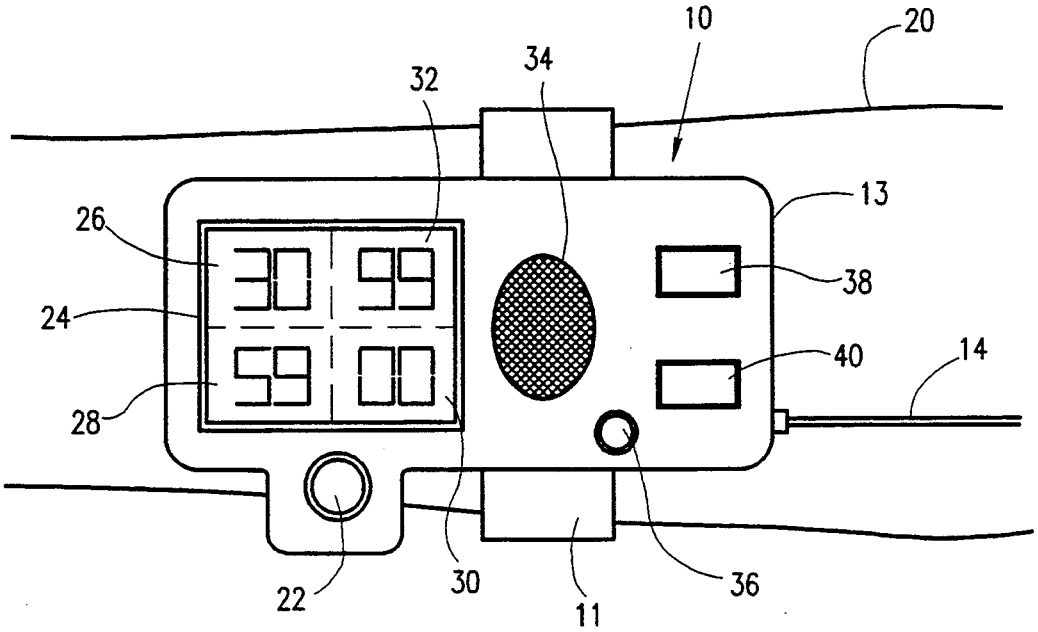
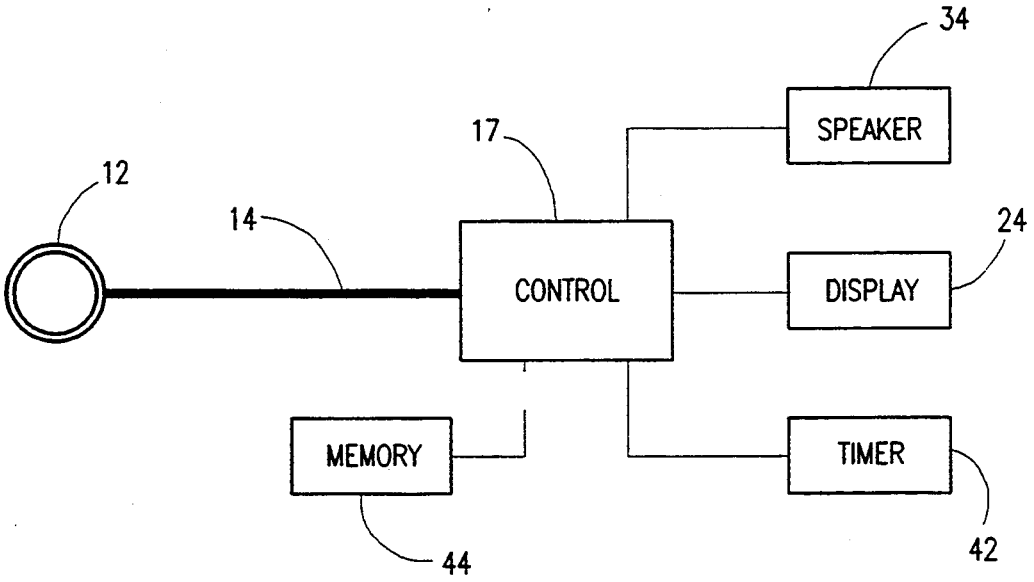
FIG.3

CONSUMPTION CONTROL

FIELD OF THE INVENTION

The present invention relates to dieting in general and, more particularly, to methods and apparatus for controlling consumption.

BACKGROUND OF THE INVENTION

There are countless methods and apparatus for dieting known in the art. Diets and other nutritional interventions have various purposes, but they are mainly concerned with controlling weight (e.g. loosing weight) and maintaining a healthy body. Normally, dieting is based on consumption of food in accordance with preselected menus and meal schedules, provided by dietitians, nutritionists, physicians and other specialists and non-specialists. Diet plans are typically acquired from books which are normally directed to the general public, or directly from a diet specialist through personal or group sessions.

There have also been attempts to implement more drastic means and methods for reducing weight. For example, there are diet camps where dieters lodge for prolonged periods of time. During their stay, the dieters are subject to a supervised daily schedule including strictly calorie-calculated meals and exercise plans. Another method, which has been used in the past but has proven to be dangerous, includes installment of irremovable restrictive metal jaws which prevent the user from eating in the usual manner.

Although some of the above mentioned methods have proven to be effective for limited periods of time, none of the methods provide a long-term solution for the problems of improper nutritional habits and/or overeating. Furthermore, some of the more effective methods are expensive and time consuming, let alone painful, cruel and humiliating.

It is well known that the food consumption rate is an important factor in acquiring healthy eating habits. In addition to symbolizing bad manners, fast eating is unhealthy and usually results in overeating and stomach discomforts and/or indigestion. These disadvantages of fast eating are mainly attributed to the fact that food digestion is a delayed and lengthy process. It is also well known that the sensation of "being full" is established only a considerable period of time following actual "eating to the full". This sensational delay-time may vary from one person to another, but it is normally in the order of twenty minutes. Thus, a fast eater often finds himself eating in great excess over the amount of food sufficient for quenching his or her hunger, without actually feeling full.

Scientific research has shown that the feeling of hunger is partially controlled by a group of cells in the lower brain. These cells act as appetite regulators, regulating the feeling of hunger in accordance with the sugar level in the blood. When the sugar level is under a certain level the person feels hungry, and when the sugar level is at a normal level, or above the normal level, the person feels full.

It is also well known that chewing is an important digestion aid. The enzyme Ptyalin in the human saliva decomposes long carbohydrate chains into sugars. It is appreciated that fast eating results in insufficient chewing which unduly burdens the digestion of food.

SUMMARY OF THE INVENTION

Unfortunately, conscious awareness of improper habits of consumption does not solve the problems of overeating and unhealthy consumption. Therefore, such awareness does not obviate the need for techniques for controlling food consumption rates and instilling proper habits.

It is, thus, an object of the present invention to provide a method and apparatus for controlling the food consumption rate of a user.

In accordance with a preferred embodiment of the present invention, the food consumption rate of the user is determined by measuring the rate at which the person performs preselected body motions indicative of food consumption.

Apparatus constructed in accordance with a preferred embodiment of the present invention preferably include a position detector operative for determining whether the eating arm of the user is in an eating position, wherein the eating arm is folded to a predetermined extent typical of eating, or in a non-eating position. In a preferred embodiment of the invention, the consumption control apparatus further includes a timer operative for measuring the time lapse between consecutive eating position events, thereby determining an actual eating-motion rate of the user. Preferably, the time measured between eating positions does not include the durations of the eating positions and. Thus, eating position durations are preferably not taken into account in determining the actual eating-motion rate.

In accordance with a preferred embodiment of the invention, when operating in a performance-supervision mode thereof, the actual eating-motion rate is compared with a preselected standard rate, adapted for the specific user. Preferably, the consumption control apparatus also includes a performance indicator operative to communicate an indication responsive to the correlation between the actual and standard rates. More preferably, the correlation indication includes an indication, sensible to the user, which is generated whenever the actual rate deviates from the standard rate and, particularly, when the actual rate is higher (i.e. when eating motions are more frequent) than the standard rate.

A preferred embodiment of the invention also includes a memory operative to record events corresponding to an unacceptable deviation from the standard rate. The memory is, preferably, not readily accessible by the user but only by a supervisor of the treatment, so that the user will not be tempted to tamper with his or her performance record. More preferably, the stored information can be recalled from memory by the user and displayed, but cannot be altered/erased/added by the user without leaving noticeable traces.

According to one, preferred, embodiment of the invention, the consumption control apparatus can operate in a learning/practice mode, in which the performance indicator generates a periodic, preferably pulsed, indication of the standard rate, regardless of whether or not the user complies with the standard rate. In this preferred embodiment of the invention, the user can learn to eat at a proper rate without being "punished". Preferably, deviations from the standard rate are not registered and/or memorized during the learning/practice mode of operation.

Alternatively, the learn/practice mode and the performance supervision mode are used simultaneously. According to this preferred embodiment, the indication of the standard rate is generated along with the indication and registration of deviations, for the duration of the consumption session (i.e. the meal). More preferably, the learn/practice mode is automatically activated at the beginning of each consumption session and automatically deactivated after a preselected initial learn/-practice interval and, additionally or alternatively, automatically reactivated for an additional learn/practice period following each deviation from the standard rate. Deviations from the standard eating rate are preferably indicated and registered at all times.

Further, in accordance with a preferred embodiment of the invention, the position detector includes a position switch attached to a preselected location on the body of the user, preferably on the arm and, more preferably, in the inner elbow region. According to a preferred embodiment of the invention, the position switch is adapted to be in an "eating" position only when the arm of the user is folded to a position typical of eating.

In a preferred embodiment of the invention, the indication generated by the performance indicator in the learning mode includes a series of weak electric pulses, which are sensible by the user, generated in accordance with the standard rate.

Further, in a preferred embodiment of the invention, the indication generated by the performance indicator, in the performance supervision mode, includes and audio indication, such as a "beep" or a "buzz" or a word/sentence, for each unacceptable deviation of the actual rate from the standard rate.

BRIEF DESCRIPTION OF THE DRAWINGS

The present invention will be understood and appreciated more fully from the following detailed description of preferred embodiments of the invention, taken in conjunction with the drawings in which:

FIG. 1A is a pictorial illustration of consumption control apparatus, constructed and operative in accordance with a preferred embodiment of the present invention, mounted on the arm of a person in a non eating position;

FIG. 1B is a pictorial illustration as in FIG. 1A, but wherein the arm of the person is in an eating position;

FIG. 2 is a more detailed, pictorial, illustration of part of the consumption control apparatus of FIGS. 1A and 1B;

FIG. 3 is a schematic diagram of the circuitry of the apparatus of FIGS. 1A, 1B and 2.

DETAILED DESCRIPTION OF A PREFERRED EMBODIMENT

Figure 4:
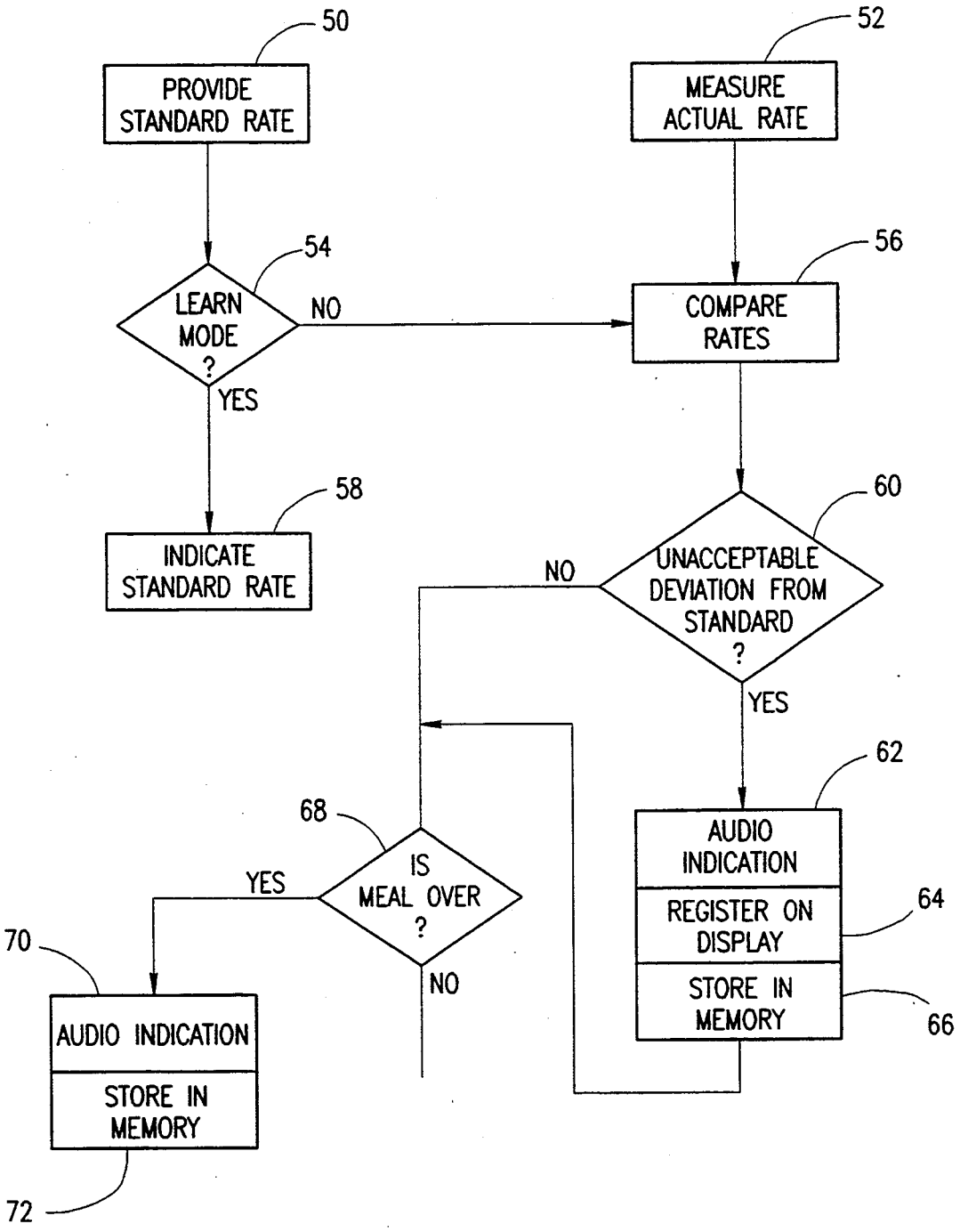
FIG. 4 is a flow chart illustrating, generally, the operation of the apparatus of FIGS. 1–3.

Reference is now made to FIGS. 1A and 1B which pictorially illustrate consumption control apparatus 8 in accordance with the present invention, mounted on an eating arm 15 of a user 18. As can be seen in FIGS. 1A and 1B, the consumption control apparatus includes a main unit 10 and a remote switch 12. Main unit 10 is preferably mounted on the lower arm portion 20 of the eating arm 15 of user 18, preferably by means of a strap 11 such as a wristwatch strap. Alternatively, unit 10 may be located on the wrist, and normal features of a wrist watch (i.e. a display of hour, minutes, seconds, date, etc.), which are not shown and described herein, are preferably built into unit 10. It should be appreciated, however, that the location of main unit 10 on arm 15 is not inherent to the present invention and, therefore, any other location may be equally suitable.

Remote switch 12 is mounted on arm 15 of user 18, preferably in the inner elbow region and, more preferably, slightly above the elbow, for example 5–7 centimeters above the elbow. Alternatively, switch 12 may be located on the lower arm of user 18 and, in this preferred embodiment of the invention (not shown in the Figures), switch 12 is preferably integrated with unit 10 to form a single consumption control unit. It is appreciated that regardless of whether switch 12 is located on the lower or upper portion of arm 15 of user 18, sufficient folding of arm 15 will result in activation of switch 12, as described in detail below.

In a preferred embodiment, switch 12 is associated with unit 10, preferably via an electric cord 14. Alternatively, switch 12 can be cordless, if main unit 10 is properly adapted for cordless communication with switch 12, or cord 14 can be of a color similar to that of the skin of user 18. It should be appreciated that if relatively long sleeved shirts are worn by user 18, switch 12 and wire 14 may be hidden (not shown in the Figures) but still operable. As described above, switch 12 and main unit 10 may be integrated into a single consumption control unit and, in this embodiment, switch 12 communicates with unit 10 through internal circuitry (not shown), thereby obviating the need for cord or cordless communication.

FIG. 1A shows user 18 in a non-eating position, wherein eating arm 15 is only partially folded, while FIG. 1B depicts an eating position, wherein eating arm 15 is almost completely folded in order to bring food 16 into the mouth of user 18. It should be appreciated by a person skilled in the art that the eating position of FIG. 1B is unique, since it is characterized by a unique angle ($\alpha$), between the upper and lower portions of arm 15, which seldom occurs other than during eating. Furthermore, it should be appreciated that angle $\alpha$, which may be different for different users 18, varies only slightly (practically invariable) for different shoulder positions of the same user 18. Thus, it is possible to distinguish an eating position from a non-eating position based on the angle defined by the inner elbow area.

In a preferred embodiment of the invention, switch 12 is constructed and mounted so as to be activated only when arm 15 is folded beyond a certain extent (i.e. when the inner elbow angle is less than or equal to $\alpha$). To achieve that purpose, switch 12 is preferably located, as shown in FIGS. 1A and 1B, in a position suitable for the specific user 18 (i.e. a position wherein the switch is activated only when arm 15 is in an eating position). Since the apparatus is preferably mounted and supervised by an expert, initial selection of the correct location for switch 12 may also be performed by the supervising expert. It should be appreciated that switch 12 may be a spring-loaded switch, a capacitive switch or any other switch known in the art, as long as its sensitivity to contact and/or pressure (depending on the type of switch used) provides sufficient resolution in detecting angle $\alpha$.

Alternatively, switch 12 may be a flexible, disk-shaped, switch (not shown) located at the center of the inner elbow such that folding of the arm at an angle equal to $\alpha$ or less causes sufficient bending of switch 12 and, thereby, activation of the switch. It should be appreciated that various types of switches and various suitable switch locations may be equally suitable for detecting an eating position and, thus, the options described above are mere examples.

Reference is now made also to FIG. 2, which pictorially illustrates main unit 10 mounted on an area 20 of arm 15 of user 18. As seen in FIG. 2, main unit 10 is housed in a preferably thin, preferably light weight, preferably water proof, envelope 13. Mounted on the upper surface of unit 10 there is a visual display unit 24, including displays 26, 28, 30 and 32, a speaker 34, set buttons 38 and 40, a mode select switch 36 and a meal reset button 22. The operation of all of the above mentioned components will be described in detail below.

Referring additionally to FIG. 3, which schematically illustrates the circuitry of the present apparatus, main unit 10 includes a control unit 17 which receives inputs from remote switch 12 and a timer 42, and generates selective outputs to display unit 24 and speaker 34. Preferably, control unit 17 also communicates with a memory 44, as will be described below.

In a preferred embodiment of the invention, button 38 is used for setting a standard consumption rate, i.e. the desired time interval between consecutive eating events, preferably measured in seconds, which preferably appears on display 26 of display unit 24 for reference by user 18. Similarly, in a preferred embodiment, button 40 is used for setting a standard time for an entire meal, which preferably appears on display 32 of display unit 24, preferably in a form which indicates the time (for example, in minutes) remaining to the desired "end of meal". It is appreciated that the standard meal time is preferably equal to at least the time required for person 18 to sense the full impact of food 16 on his craving for food (typically, at least 20 minutes). The standard eating rate and meal time are preferably dictated by a supervising expert and in accordance with the eating habits of user 18. For example, the average amount of food consumed by a given user 18, in each bite, may be an important factor in determining the standard eating rate suitable for the given user.

Reference is now also made to FIG. 4, which is a flow chart generally describing a preferred mode of operation of the present apparatus. Timer 42 (FIG. 3), included in main unit 10, provides control unit 17 with the standard eating rate (block 50 in FIG. 4), as previously adjusted through button 38. The actual eating rate, i.e. the time period between successive activations of remote switch 12, is measured by control unit 17 (FIG. 3) as indicated at block 52.

As mentioned above, unit 10 includes a mode-select switch 36 (FIG. 2). As implied at block 54 (FIG. 4), switch 36 preferably defines at least two modes of operation of unit 10, namely, a learn/practice mode and a consumption control mode. Preferably, switch 36 also defines a combined mode wherein the learn/practice mode and the consumption control mode are both operative. Additionally or alternatively, switch 36 defines an automatic learn/practice mode, in which the learn/practice mode is activated automatically at the beginning of each consumption session (i.e meal) and/or whenever the eating rate deviates from a desired standard (as described below), and automatically deactivated after a preselected learn/practice period. It should be appreciated that other modes of operation as well as other combinations of modes, which may be found suitable, are also within the scope of the present invention.

In a preferred learn/practice mode, unit 10 generates a sensible indication (block 58) of the standard eating rate, preferably in the form of weak electric currents driven into the arm 15 of user 18 through suitable electrodes (not shown in the Figs.). In a preferred embodiment of the invention, unit 10 generates a series of short electric pulses, spaced in accordance with the standard eating rate, providing user 18 with an initial, preferably pre-meal, reference rate. After user 18 has internalized the standard rate, he may switch, by virtue of switch 36, to the consumption control mode.

In the consumption control mode, control unit 17 compares the actual rate to the standard rate (block 56), thereby determining whether an unacceptable deviation from the standard rate has occurred (block 60). Normally, an unacceptable deviation occurs when the actual rate is higher (i.e. shorter time between successive eating positions) than the standard rate. For example, if the minimum rest period between successive eating positions is set at 30 seconds, for a given user 18, any interval shorter than 30 seconds will be deemed unacceptable. However, it should be appreciated that for other purposes, a maximum rest period may also be desired.

Whenever an unacceptable deviation occurs, control unit 17 generates a sensible indication to user 18, preferably an audio indication (block 62) and, more preferably, a sound output through speaker 34 (FIG. 2). The sound output may include a disturbing sound or, preferably, a human voice imitation reciting an educational remark such as, for example, "don't eat so fast" or "slow down". In a preferred embodiment of the invention, the audio indication is sufficiently loud to be heard by persons in the vicinity of user 18, thereby providing an additional motive for complying with the standard rate. If the consumption control apparatus is operated in the automatic learn/practice mode, preferably provided by switch 36 as described above, the learn practice mode is automatically activated for a preselected time period subsequent to each unacceptable deviation.

In addition to their sensible indications, unacceptable deviations are preferably also registered on display 28 of display unit 24, so that user 18 can be updated as to the number of unacceptable deviations during a meal. Preferably, the number of deviations is also stored (block 66) in memory 44 (FIG. 3) for subsequent reference. For optimal supervision, memory 44 is designed to be inaccessible by user 18, using conventional methods, so that the information stored in memory 18 will reflect a true log of the consumption activity of user 18.

In a preferred embodiment of the invention, the number of deviations is stored along with additional information such as, for example, the date and time of meal, approximated number of calories consumed, the duration of the meal (as explained below) and any other relevant information. It should be appreciated that such information can be entered to memory 44 using suitable conventional apparatus (not shown in the Figures).

It is appreciated that, even at the standard eating rate, when user 18 consumes food continuously for a long period of time, he may over-eat. Thus, in a preferred embodiment of the invention, control unit 17 provides a sensible indication when the standard meal time, as set by button 40 (FIG. 2), expires (block 68 in FIG. 4). Preferably, the sensible indication includes an audio indication (block 70), for example a buzz, produced by speaker 34 and/or a visual indication, preferably produced by a light emitting diode (not shown). Additionally, control unit 17 is preferably operative for measuring the actual meal time which, at the end of the meal, is preferably stored in memory 44 (block 72). Preferably, the indication and registration of the actual consumption rate continues throughout the actual meal time, even after the standard meal time has expired.

Meal reset button 22 (FIG. 2) is preferably pressed once at the beginning of a meal, at which time the number of unacceptable deviations is set to zero, and once at the end of a meal, at which time the actual meal time is measured. In a preferred embodiment of the invention, every depression of button 22 is recorded in memory 44. In an alternative, preferred, embodiment of the invention, button 22 is used only to activate the consumption control apparatus at the beginning of the meal, while deactivation of the apparatus is automatically executed after a preselected time period, for example a period of one hour. In this preferred embodiment, user 18 cannot bypass the present apparatus by depressing button 22 before the end of the meal.

User 18 using the consumption control apparatus is preferably supervised by a diet expert. In periodic sessions, the diet expert reviews the information stored in memory 44 and directs the client accordingly. Preferably, memory 44 can be erased only through a traceable procedure performed by the diet expert, so that user 18 will not be tempted to tamper with the information in memory 44.

It should be appreciated that the present consumption control apparatus can also be used to keep track of the number of times arm 15 of user 18 has been folded. For example, if user 18 sets a very low standard eating rate using button 38, any folding of his arm 15 will be registered as an unacceptable deviation, thereby keeping an accurate count of the number of foldings. This may be useful as a counting aid for a user 18 lifting one-arm weights.

Alternatively, a count of the total number of eating positions, i.e. foldings of arm 15, can be used for preliminary consumption monitoring of a new user 18. Based on the number of eating positions in a meal and the amount of food/calories consumed during the meal, the diet supervisor can determine optimal values for the standard eating rate and the standard meal time.

It will be appreciated by persons skilled in the art that the present invention is not limited by what has been particularly shown and described herein. Rather, the scope of the present invention is defined only by the claims which follow:

I claim:

1. Consumption control apparatus comprising:

a rate meter operative for determining an actual rate at which an arm of a user is brought into an eating position during a consumption session; and an indicator operative for providing a sensible indication whenever the actual rate deviates unacceptably from a preselected, standard, eating rate.

2. Apparatus according to claim 1 wherein the sensible indication includes an audio indication.

3. Apparatus according to claim 2 wherein the indicator provides the user, during preselected learn/practice time intervals, with a sensible indication corresponding to the preselected standard rate.

4. Apparatus according to claim 1 wherein the indicator provides the user, during preselected learn/practice time intervals, with a sensible indication corresponding to the preselected standard rate.

5. Apparatus according to claim 4 wherein the sensible indication corresponding to the standard rate includes a series of sensible pulses separated by intervals corresponding to the standard rate.

6. Apparatus according to claim 4 wherein a learn/practice time interval is automatically initiated at the beginning of each consumption session.

7. Apparatus according to claim 6 wherein a learn/practice time interval is initiated following each unacceptable deviation from the standard eating rate.

8. Apparatus according to claim 4 and further comprising a visual display for displaying the number of unacceptable deviations from the preselected eating rate.

9. Apparatus according to claim 8 wherein the indicator provides a sensible indication at the expiration of a preselected meal time.

10. Apparatus according to claim 9 and further comprising a memory operative for recording the number of unacceptable deviations detected during the consumption session.

11. Apparatus according to claim 10 wherein the memory further records the duration of each consumption session.

12. Apparatus according to claim 9 wherein the rate meter comprises a position switch, associated with the arm of the user, which is activated each time the arm of the user is brought into the eating position.

13. Apparatus according to claim 12 wherein the position switch is located near the inner elbow of the eating arm of the user so as to be activated each time the eating arm is folded to the eating position.

14. Apparatus according to claim 4 wherein the indicator provides a sensible indication at the expiration of a preselected meal time.

15. Apparatus according to claim 14 and further comprising a memory operative for recording the number of unacceptable deviations detected during the consumption session.

16. Apparatus according to claim 15 wherein the memory further records the duration of each consumption session.

17. Apparatus according to claim 14 wherein the rate meter comprises a position switch, associated with the arm of the user, which is activated each time the arm of the user is brought into the eating position.

18. Apparatus according to claim 17 wherein the position switch is located near the inner elbow of the eating arm of the user so as to be activated each time the eating arm is folded to the eating position.

19. Apparatus according to claim 4 and further comprising a memory operative for recording the number of unacceptable deviations detected during the consumption session.

20. Apparatus according to claim 4 wherein the rate meter comprises a position switch, associated with the arm of the user, which is activated each time the arm of the user is brought into the eating position.

21. Apparatus according to claim 20 wherein the position switch is located near the inner elbow of the eating arm of the user so as to be activated each time the eating arm is folded to the eating position.

22. Apparatus according to claim 1 and further comprising a visual display for displaying the number of unacceptable deviations from the preselected eating rate.

23. Apparatus according to claim 22 wherein the indicator provides a sensible indication at the expiration of a preselected meal time.

24. Apparatus according to claim 1 wherein the indicator provides a sensible indication at the expiration of a preselected meal time.

25. Apparatus according to claim 1 and further comprising a memory operative for recording the number of unacceptable deviations detected during the consumption session.

26. Apparatus according to claim 25 wherein the information stored in memory is protected, such that tampering of the user with the stored information is detectable.

27. Apparatus according to claim 25 wherein the rate meter comprises a position switch, associated with the arm of the user, which is activated each time the arm of the user is brought into the eating position.

28. Apparatus according to claim 1 wherein the rate meter comprises a position switch, associated with the arm of the user, which is activated each time the arm of the user is brought into the eating position.

29. Apparatus according to claim 28 wherein the position switch is located near the inner elbow of the eating arm of the user so as to be activated each time the eating arm is folded to the eating position.

30. A consumption control method comprising the steps of:

determining an actual rate at which an eating arm of a user is brought into an eating position during a consumption session; and providing a sensible indication whenever the actual rate deviates unacceptably from a preselected, standard, eating rate.

31. A method according to claim 30 and further comprising the step of providing the user, during preselected learn/practice time intervals, with a sensible indication corresponding to the preselected standard rate.

32. A method according to claim 31 and further comprising the step of indicating the expiration of a preselected meal time.

33. A method according to claim 32 and further comprising the step of recording the number of unacceptable deviations detected during the consumption session.

34. A method according to claim 33 and further comprising the step of recording the duration of each consumption session.

35. A method according to claim 31 and further comprising the step of recording the number of unacceptable deviations detected during the consumption session.

36. A method according to claim 31 wherein the step of determining the actual rate comprises the steps of:

mounting onto the eating arm of the user a position switch which is activated only when the eating arm is brought into the eating position; and measuring the time lapsed between successive activations of the position switch.

37. A method according to claim 30 and further comprising the step of visually displaying the number of unacceptable deviations from the preselected eating rate.

38. A method according to claim 30 and further comprising the step of indicating the expiration of a preselected meal time.

39. A method according to claim 38 and further comprising the step of recording the number of unacceptable deviations detected during the consumption session.

40. A method according to claim 39 and further comprising the step of recording the duration of each consumption session.

41. A method according to claim 40 wherein the step of determining the actual rate comprises the steps of:

mounting onto the eating arm of the user a position switch which is activated only when the eating arm is brought into the eating position; and measuring the time lapsed between successive activations of the position switch.

42. A method according to claim 39 wherein the step of determining the actual rate comprises the steps of:

mounting onto the eating arm of the user a position switch which is activated only when the eating arm is brought into the eating position; and measuring the time lapsed between successive activations of the position switch.

43. A method according to claim 38 wherein the step of determining the actual rate comprises the steps of:

mounting onto the eating arm of the user a position switch which is activated only when the eating arm is brought into the eating position; and measuring the time lapsed between successive activations of the position switch.

44. A method according to claim 30 and further comprising the step of recording the number of unacceptable deviations detected during the consumption session.

45. A method according to claim 44 wherein the step of determining the actual rate comprises the steps of:

mounting onto the eating arm of the user a position switch which is activated only when the eating arm is brought into the eating position; and measuring the time lapsed between successive activations of the position switch.

46. A method according to claim 30 wherein the step of determining the actual rate comprises the steps of:

mounting onto the eating arm of the user a position switch which is activated only when the eating arm is brought into the eating position; and measuring the time lapsed between successive activations of the position switch.

47. A method according to claim 30 wherein the sensible indication includes an audio indication.

* * * * *